US008002429B2

(12) United States Patent
Ambroggio et al.

(10) Patent No.: US 8,002,429 B2
(45) Date of Patent: Aug. 23, 2011

(54) LANTERN CANDLE WITH TRANSLUCENT CASING

(75) Inventors: Piergiorgio Ambroggio, Turin (IT); Giuseppe Ambroggio, Ravoli (IT)

(73) Assignee: SER S.p.A, Santena (IT)

( * ) Notice: Subject to any disclaimer, the term of this patent is extended or adjusted under 35 U.S.C. 154(b) by 232 days.

(21) Appl. No.: 12/294,673

(22) PCT Filed: Mar. 29, 2007

(86) PCT No.: PCT/EP2007/002818

§ 371 (c)(1),
(2), (4) Date: Oct. 31, 2008

(87) PCT Pub. No.: WO2007/112941

PCT Pub. Date: Oct. 11, 2007

(65) Prior Publication Data

US 2009/0067164 A1 Mar. 12, 2009

(30) Foreign Application Priority Data

Mar. 30, 2006 (EP) ..... 06425229

(51) Int. Cl.
*F21V 33/00* (2006.01)

(52) U.S. Cl. ..... 362/154; 362/161; 431/288; 431/289

(58) Field of Classification Search ..... 362/154, 362/157, 159, 161, 171, 806; 431/288–289, 431/291

See application file for complete search history.

(56) References Cited

U.S. PATENT DOCUMENTS 6,059,564 A * 5/2000 Morris ..... 431/291
6,589,047 B1 * 7/2003 Papai ..... 431/291

FOREIGN PATENT DOCUMENTS

DE 213931 C 6/1919
EP 0437662 A1 7/1991
FR 2753777 A 3/1998

* cited by examiner

*Primary Examiner* — Stephen F Husar
*Assistant Examiner* — Meghan K Dunwiddie
(74) *Attorney, Agent, or Firm* — Harness, Dickey & Pierce, PLC

(57) ABSTRACT

A lantern candle comprises a candle and a cup for receiving it, wherein the cup comprises a casing made of absorbent material such as paper or cardboard or a multi-layer laminate based thereon, which is soaked with a wax so that the casing is substantially immediately translucent upon lighting the candle. A method for making a lantern candle comprises the steps of forming a casing by preparing an absorbent material such as paper or cardboard or a multi-layer laminate based thereon, forming a cup for receiving a candle by joining a bottom to the casing, introducing a candle wax and a wick into the prepared cup, and soaking the absorbent material or the paper or cardboard with wax, so as to render it substantially immediately translucent upon lighting the candle.

15 Claims, 1 Drawing Sheet

LANTERN CANDLE WITH TRANSLUCENT CASING

FIELD

The present disclosure relates to a lantern candle, in particular, a lantern candle with a translucent sheathing or casing. The invention also relates to a method for making such a lantern candle.

BACKGROUND

Lantern candles are used, for example, as grave lights or decorative lights and have casings for better handling, for avoiding hot candle wax running out or dripping, and for decorative purposes.

Already at the beginning of the $20^{th}$ century, candles inserted into cup-like containers, so-called lantern candles, were used, their containers being initially made out of metal and later out of paper or cardboard due to their lower heat conduction. A lantern candle comprising a paraffin wax candle and a paper or cardboard cup for receiving it is known, for example, from DE-C-312931, wherein a metal lid having an opening for the wick is arranged at the open side of the cup. Since the material of the container needs to be resistant against atmospheric influences, such as in the case of grave lights, the paper or cardboard was substituted in subsequent development by colored plastic materials, in particular, PVC.

Such lantern candles generally comprise a plastic cup with a wax candle, generally made of paraffin wax, inserted or poured into the cup and a wick. Often a protective or decorative metal lid is provided at the opening of the cup. Depending on size, the candles have a burning time between several hours and several days.

The draw-back of lantern candles having a plastic casing is that, after burning down, the lantern candle is not completely biodegradable or recyclable due to the use of the plastic cup material. Although the metallic components of the lid may be recyclable, the plastic material of the casing is seldom recyclable and, moreover, when burned, forms toxic gases, in particular, hydrogen chloride in case of PVC cups.

To solve this problem, document EP 0 437 662 by the Applicant proposes a lantern candle having an environmentally friendly, biodegradable or burnable casing made of a multi-layer paper laminate. Also in terms of aesthetic appearance, the casing made of paper laminate has advantages with respect to the plastic material because paper can be more easily printed upon with diverse colors and diverse patterns as well as photographs.

Although this solution constitutes a step ahead in terms of environmentally friendly disposal of the burnt-down lantern candle as compared to candles with a plastic casing, the conventional paper casing is not completely satisfactory in terms of light diffusion and aesthetic appearance. If the candle is burning, light from the flame initially only passes through a region of the casing lying approximately at the same height as the burning wig. Only after a sufficient proportion of candle wax has melted and the paper casing has been soaked, the whole area of the paper casing contributes to a uniform light diffusion, and a so-called translucent effect can be achieved. However, this happens only after some hours, a fact that is not acceptable if the light is to be used as a decorative light, for instance at home. Further, there is a danger that a casing gets soaked incompletely or not uniformly, leading to ugly darker and lighter stains on the casing.

SUMMARY

Therefore, it is an object of the present invention to provide a lantern candle which not only is recyclable or disposable in an environmentally friendly manner, but which addresses also the aesthetic needs of clients in terms of an immediate and uniform light diffusion.

This object is achieved by a lantern candle according to claim 1 and a method for making a lantern candle according to claim 10. Further, preferred embodiments are defined in the dependent claims.

The lantern candle according to the invention comprises a candle made of candle material and a cup receiving the candle, wherein the cup comprises a casing made from an absorbent material. The lantern candle is characterized in that the absorbent material is soaked with a wax so that the casing is immediately translucent when the candle is burning.

The method for making a lantern candle according to the invention comprises the following steps: forming a casing by preparing an absorbent material, forming a cup for receiving a candle by joining a bottom to the casing, introducing candle material and a wick into the prepared cup, and soaking the absorbent material with wax, so as to render it substantially immediately translucent upon lighting the candle. It is to be emphasized that the method of the invention does not rely on the steps being performed in the given order. For example, the step of soaking may be performed prior to forming the cup, or thereafter.

As far as, in the following description and the claims, the claimed object is referred to as "lantern candle", it is to be understood that a corresponding candle or light with the mentioned structure is also contemplated and that it need not necessarily be used for the function of a "lantern candle" as initially mentioned. It will, in fact, be obvious to the person skilled in the art that the product claimed by the invention can be used also for other purposes. Thus, the present invention of course covers also cases in which such a candle is used for purposes other than on graves or for decoration.

An important feature of the present invention is, therefore, to be seen in the fact that the conventional multi-layer laminate is substituted by an absorbent material which, due to its soaking with wax, achieves the immediate translucency of the casing (the sheathing) at the outset without requiring a lengthy soaking process after lighting the candle. It is to be understood that the substance referred to by the term "wax", both for soaking the absorbent material and for making the candle as such, may be any substance suitable for the stated purpose such as oil, and that the wax, oil or the like may be either scented or unscented according to the wishes of the consumer.

It is also to be understood that the term absorbent material as used herein refers to any material that possesses the necessary mechanical strength for forming the casing, and is capable to absorb the wax as stated above. Also, the material will be biodegradable or disposable in an environmentally friendly way. As such, an absorbent material may, for instance, be paper or cardboard, or a multi-layer laminate based on paper or cardboard, but other materials are possible as long as they fulfill the mentioned requirements.

Additionally, it is contemplated in the present invention that the color of the lantern candle determined by the casing can be varied and arbitrarily designed. In particular, the casing may be modified also by decorative printing with ornaments, figures or the like, as will be explained in more detail in the following.

DRAWINGS

In the drawings, an exemplary embodiment of the invention is illustrated.

DETAILED DESCRIPTION

Figure 1:
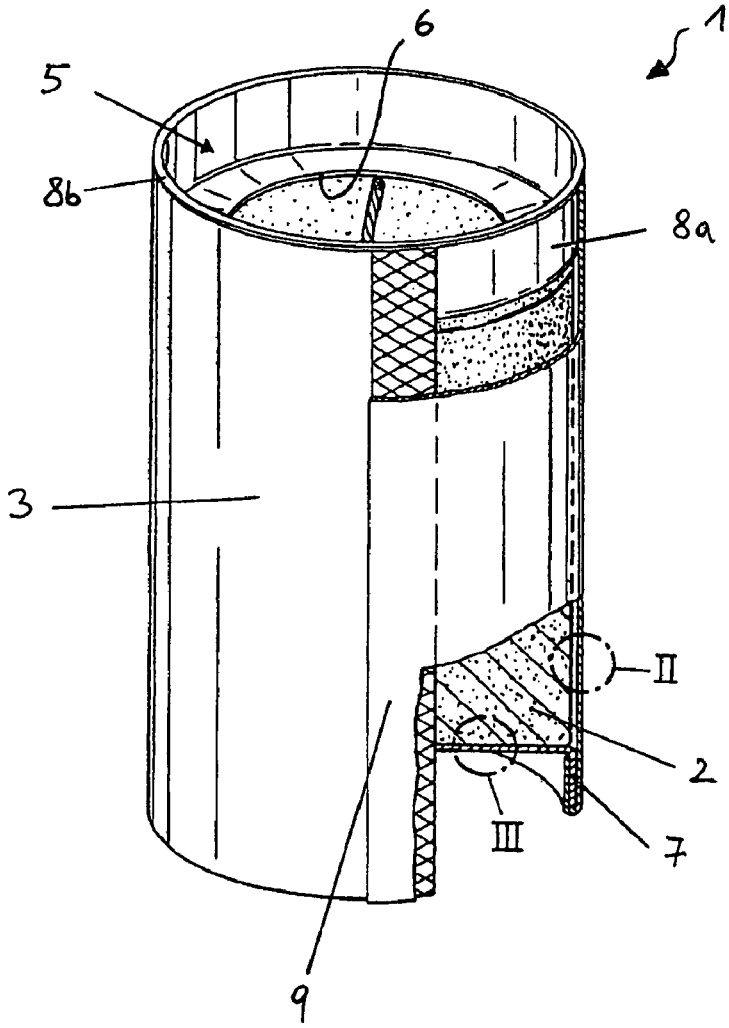
FIG. 1 is a perspective view of a partially cut-open lantern candle.
Figure 2:
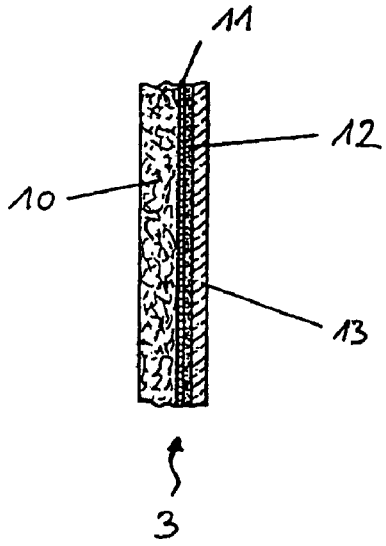
FIG. 2 is a magnified view of a portion of the casing of the lantern candle in FIG. 1.
Figure 3:
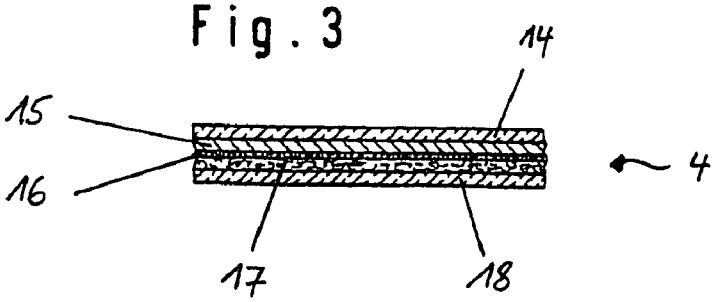
FIG. 3 is a magnified view of a bottom portion of the lantern candle in FIG. 1.

Referring to FIGS. 1 and 2, the substantially cylindrical casing 3 of the cup enclosing the candle 2, which may comprise paraffin or the like, has a structure characteristic of the present invention. This casing is formed as a multi-layer laminate, wherein the structure of the laminate, from the inside to the outside, is the following (FIG. 2):

On the inside there is a paper or cardboard layer 10, preferably made from white cardboard. The cardboard 10 has a certain absorbency and is made preferably from several layers of pure cellulose. In particular, a structure made up of five layers of pure cellulose with a grammage of about 300 grams/$m^2$ and a further layer with a grammage of about 25 grams/$m^2$ has been found advantageous in practice.

The cardboard 10 may be pre-treated and impregnated (soaked) separately before the assembly of the candle, and the candle may subsequently be inserted either in solid form or poured into the multi-layer cup in liquid form. Alternatively, the cardboard 10 may be impregnated (soaked) during the production of the candle by pouring in the liquid wax into the finished multi-layer cup and letting the candle wax soak into the cardboard of the multi-layer laminate. In any case, in use, the cardboard 10 will be in direct contact with the burning candle 2 and, therefore, with the initially solid and later liquefied wax.

Using this soaked cardboard layer 10 within the cylindrical casing 3 has several advantages. Before lighting the wax candle, the cylindrical casing 3 of the cup having the above-mentioned structure shows only little or no translucency. However, upon lighting of the candle, the wax softens and liquefies within as little as a few tens of seconds and, since the wax of the candle 2 is in direct contact with the wax-impregnated cardboard layer 10, or comes into contact with it upon softening and melting, a highly effective and decorative translucency promptly occurs. This translucency immediately extends along the whole surface of the casing 3, thereby giving an optically appealing effect. Since the impregnation (soaking) of the cardboard layer of the multi-layer laminate of the casing 3 is controlled to be uniform, no dark or light spots or stains appear on the translucent casing. The result is an aesthetically appealing "lantern effect".

Another advantage is that cardboard can, of course, be easily disposed of, i.e. either burned or biologically degraded. Therefore, the candle meets the growing demand by consumers for environmentally friendly products.

Yet another advantage is that cardboard can be easily colored according to need and/or printed upon with decorative designs, leading to very good results. The high affinity of the cardboard made of cellulose to many printing inks enables an excellent imprintability and colorability.

And, as still another advantage, if the candle wax is poured into the cup in liquid form, the soaked casing 3 will be firmly connected to the candle 2, thus improving the mechanical stability of the whole lantern candle and avoiding movement of the candle within the casing.

As implied above, a color layer 11 is printed onto the cardboard layer 10. The printing may be, for instance, a multi-color intaglio printing (gravure printing) employing up to eight different colors for the printing design. In this case, the print density is preferably in the range between 2 and 3 grams of printing ink/$m^2$. Of course, other printing techniques may be equally employed.

A further component in the multi-layer laminate of the cylindrical casing 3 is an adhesive or glue 12. This glue 12 is provided for adhering an outer polypropylene and, optionally, a polyethylene layer 13 onto the color layer 11. The glue 12 may be of any conventional type, for example, a conventional two-component glue. The lamination of polypropylene onto cardboard is known to the person skilled in the art so that he may choose any glue suitable for this purpose.

The outer layer of the cylindrical casing 3 is, as mentioned, made of polypropylene 13. This polypropylene renders the cylindrical casing 3 resistant to atmospheric influences and protects the cup. Since the polypropylene is used as a thin layer, it is transparent or translucent, thus ensuring full visibility of the underlying color layer 11. In the present embodiment, polypropylene having a density of 0.9 grams/$cm^3$ and softening point (Vicat) of about 139° C. is preferably used. The polypropylene layer 13 is laminated preferably in a quantity of 30 grams/$m^2$ onto the underlying layers of the casing.

The polypropylene in the outer layer of the multi-layer laminate of casing 3 has an additional function. In fact, it also serves as a sealing means between the free overlapping edges 9 of the multi-layer laminate, which extend in an axial direction of the cup. It has, in this case, the function of a hot-melt adhesive. Not only a superior and lasting joining of the overlapping edges under the influence of heat and successive cooling is achieved but this joint can also cope with the strength requirements to which the lantern candle is subjected. On the one hand, in case of outside use, such a lantern candle may be influenced strongly by the outside temperatures and the weather, while on the other hand, it is heated from the inside by the burning candle so that substantial temperature differences may act onto the lantern candle as a whole and, in particular, onto the cylindrical casing 3. However, even under these high thermal and mechanical stresses, the hot-melt seam remains intact.

The bottom 4 joined to the casing 3 of the cup may also be made of a multi-layer laminate. In particular, this preferred embodiment provides a bottom with the following structure, seen from the inside to the outside:

First, a polyethylene layer 14 having a grammage of 22 grams/$m^2$ constitutes the inner surface of the bottom 4. This polyethylene 14 may be either a low density, medium density or high density polyethylene, wherein a polyethylene having a relatively low density of about 0.918 grams/$cm^3$ is preferred, since it is obtained in a known manner by high pressure polymerisation and is, therefore, particularly suitable for the production of foils.

The polyethylene layer 14 is followed by a thin aluminum layer 15, which serves to inhibit the burning or scorching of the bottom and thus of the whole cup once the candle 2 has almost burnt down. Next, a successive layer of cardboard 17 having a weight of about 230 grams/$m^2$ is laminated onto the aluminum layer 15 by means of an adhesive, preferably an aqueous glue. The aluminum layer 15 has a grammage of about 21 grams/$m^2$. The cardboard 17 serves primarily as a reinforcement of the bottom 4. Finally, a layer of polyethylene 18 is laminated onto the cardboard 17, optionally by means of a glue as mentioned above with respect to the casing, protecting the cardboard against atmospheric influences, in particular humidity, and thereby inhibiting an absorption of water into the cardboard 17.

The edge or rim of the bottom has a cylindrical collar 7 extending downwards, which on the one hand serves to distance the bottom 4 from the surface the cup is standing on, and on the other hand serves as a flanging or border crimping surface for the lower rim of the cylindrical casing 3.

The outer and inner polyethylene layers 14 and 18 of the bottom 4 act additionally as a hot-melt sealant, when the lower rim of the casing 3 is wrapped or crimped around the collar 7 of the bottom 4. In this way, a pouring out of liquid candle material through the flanging or crimping bead is avoided.

On the open upper side of the cup, a metal lid 5 having an opening 6 is arranged. Preferably, this lid 5 is made of aluminum and has a conical collar 8*a* in order to be inserted into the opening of the cup. Further, the collar of the lid 5 has a rim 8*b* to be supported on the rim of the cup opening. This rim 8*b* avoids inserting the lid 5 too deeply into the cylindrical casing 3. In a preferred embodiment, the opening 6 in lid 5 is circular and formed co-axially to the collar 8*a* of the lid. Instead of a single lid opening 6, several circular or cross-shaped openings may be provided, which are formed in lid 5 in a symmetrical arrangement with respect to the vertical axis of the cup.

On the one hand, lid 5 has the function to stabilize the easily bendable casing 3 on its upper side and to provide a high degree of rigidity to the entire lantern candle. On the other hand, its defined opening 6 serves for controlling the flame or controlling the supply of air reaching the flame.

Moreover, lid 5 may add decorative emphasis to the lantern candle and prevent, at least partially, dirt, humidity, small objects or the like from penetrating into the inside of the cup. The rim 8*b* of lid 5, which covers the free upper opening of the casing, also effectively prevents humidity or water from penetrating into the upper rim of the cup and thereby prevents a moistening and softening of the upper rim of the cup that otherwise would deteriorate the aesthetic appearance of the cup.

The lantern candle described above provides a superior aesthetic appearance substantially immediately upon lighting the candle. It addresses the growing importance of environmental requirements and can, moreover, be produced in a simple and cost effective manner. Therefore, this new lantern candle achieves the long standing object of substituting plastic materials with environmentally friendly materials while at the same time satisfying even the most sophisticated aesthetic demands of the consumer.

What is claimed is:

1. A lantern candle comprising a candle material and a cup for receiving it, wherein the cup is formed from a casing made of absorbent material and a bottom, characterized in that the absorbent material is pre-impregnated with wax so that upon lighting the candle, the casing is substantially immediately translucent.

2. The lantern candle of claim 1, characterized in that the casing is substantially cylindrical.

3. The lantern candle of claim 1, characterized in that the absorbent material is paper or cardboard.

4. The lantern candle of claim 1 characterized in that the absorbent material is a multi-layer laminate based on paper or cardboard.

5. The lantern candle of claim 4, characterized in that the multi-layer laminate of the casing comprises a polypropylene layer.

6. The lantern candle of claim 4, characterized in that the multi-layer laminate of the casing comprises one or more color layers.

7. The lantern candle of claim 5, characterized in that overlapping edges of the casing extending in an axial direction to the cylindrical cup are joined and sealed together by means of the polypropylene layer.

8. The lantern candle of claim 4, characterized in that the multi-layer laminate comprises an adhesive.

9. The lantern candle of claim 1, characterized in that the lantern candle further comprises, at the open, upper side of the cup, a metal lid having at least one opening.

10. A method for making a lantern candle, comprising the steps of:

providing a casing formed from absorbent material, forming a cup for receiving a candle by joining a bottom to the casing, and introducing candle material and a wick into the prepared cup, pre-impregnating the absorbent material with wax, so that upon lighting the candle, the casing is substantially immediately translucent.

11. The method of claim 10, characterized in that the wax is introduced in liquid form.

12. The method of claim 11, characterized in that the absorbent material of the casing is soaked by the liquid candle material introduced.

13. The method of claim 10, characterized in that the absorbent material is soaked with wax before or during the step of forming the casing and the candle material is introduced in solid form.

14. The method of claim 10, characterized in that the absorbent material is paper or cardboard.

15. The method of claim 10, characterized in that the absorbent material is a multi-layer laminate based on paper or cardboard.

* * * * *